US007197890B2

(12) United States Patent
Taras et al.

(10) Patent No.: US 7,197,890 B2
(45) Date of Patent: Apr. 3, 2007

(54) VALVE FOR PREVENTING UNPOWERED REVERSE RUN AT SHUTDOWN

(75) Inventors: Michael F. Taras, Fayetteville, NY (US); Alexander Lifson, Manlius, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 287 days.

(21) Appl. No.: 10/938,165

(22) Filed: Sep. 10, 2004

(65) Prior Publication Data

US 2006/0056989 A1 Mar. 16, 2006

(51) Int. Cl.
*F25B 41/04* (2006.01)
*F25B 1/00* (2006.01)
*F25B 49/00* (2006.01)

(52) U.S. Cl. ..... 62/217; 62/228.3; 417/279

(58) Field of Classification Search ..... 62/228.1, 62/228.3, 217; 417/279, 291, 310; 418/55.1
See application file for complete search history.

(56) References Cited

U.S. PATENT DOCUMENTS 4,820,130 A * 4/1989 Eber et al. ..... 417/32
5,167,491 A * 12/1992 Keller et al. ..... 417/28
5,800,141 A * 9/1998 Ceylan et al. ..... 418/55.1
5,803,716 A * 9/1998 Wallis et al. ..... 417/310
5,897,299 A * 4/1999 Fukunaga ..... 417/316
6,123,528 A * 9/2000 Sun et al. ..... 418/55.1
6,179,589 B1 * 1/2001 Bass et al. ..... 418/55.1
6,299,423 B1 * 10/2001 Perevozchikov ..... 418/55.1
7,048,511 B2 * 5/2006 Weng ..... 417/32
7,160,088 B2 * 1/2007 Peyton ..... 418/55.1

* cited by examiner

*Primary Examiner*—Marc Norman
(74) *Attorney, Agent, or Firm*—Carlson Gaskey & Olds

(57) ABSTRACT

An inventive method of preventing unpowered reverse rotation in a compressor includes the steps of placing a solenoid valve at a location near compressor discharge. The valve is preferably actuated soon after the power to the motor is cut off, blocking the flow of refrigerant from expanding back toward the compression chambers of the compressor. The compressor is disclosed as a scroll compressor, but may also be a screw compressor. These two types of compressors are susceptible to undesirable unpowered reverse rotation when compressed refrigerant re-expands through the compression elements from the compressor discharge into the compressor suction. By blocking the flow of refrigerant, this unpowered reverse rotation is prevented. A high pressure switch can be positioned directly upstream of the solenoid valve to immediately stop the compressor if the valve malfunctions and blocks the flow of refrigerant during normal compressor operation. This high pressure switch will prevent the continued operation of the compressor with the blocked discharge line by sending a signal to a control to cut the power to the compressor motor. A pressure differential switch can be utilized in a similar manner to avoid undesirably high pressure differentials across the valve. Also, the valve itself may be equipped with the flow bypass that opens when pressure differential across the valve exceeds a safe limit.

36 Claims, 2 Drawing Sheets

VALVE FOR PREVENTING UNPOWERED REVERSE RUN AT SHUTDOWN

BACKGROUND OF THE INVENTION

This application relates to a valve located adjacent to a compressor discharge line, and operable to prevent backflow of compressed refrigerant into a compressor pump unit, and the resultant reverse run of the compressor upon a compressor shutdown.

Compressors are utilized in most refrigerant compression applications. In a compressor, a refrigerant is typically brought into a suction chamber that surrounds a motor for a compressor pump unit. The suction refrigerant cools the motor, and eventually travels into the compression chambers of the compressor pump unit where it is compressed, and passes through a discharge port into a discharge chamber. From the discharge chamber, the refrigerant passes into a compressor discharge tube, and then downstream to the next component in the refrigerant system.

One common type of compressors that is becoming widely utilized is a scroll compressor. In a scroll compressor, a first scroll member has a base and a generally spiral wrap extending from the base, and a second scroll member has a base and a generally spiral wrap extending from its base. The two wraps interfit to define the compression chambers. The first scroll member is caused to orbit relative to the second scroll member, and as the two orbit relative to each other, the size of the compression chambers decreases, thus compressing the entrapped refrigerant.

Scroll compressors have a problem with an issue called unpowered reverse rotation. The scroll compressor is preferably driven to orbit in a preferred direction. If the first scroll member is caused to orbit in the opposed direction, undesirable noise and potential damage to the compressor may occur, due to over-speeding of the orbiting scroll and shaft counterweights.

At shutdown of the scroll compressor, there is a significant amount of compressed refrigerant stored in the condenser and adjacent discharge piping downstream of the compressor. Upon a shutdown, this compressed refrigerant expands through the compression chambers, and drives the orbiting scroll member in the reverse direction. This is undesirable.

Discharge check valves installed inside of the scroll compressor are sometimes utilized to block the refrigerant from expanding through the scroll elements and thus preventing the reverse rotation. The check valves may have reliability problems as they can wear and break in fatigue after prolonged operation. As such, there is a concern with regard to unpowered reverse rotation as it relates to the use of the internal check valves.

A similar problem exists with screw compressors where the refrigerant can expand through the screw compression elements, if there is no adequate means to block this reverse flow of refrigerant. The rotation of screw elements in reverse can damage the screw rotors of the screw compressor.

SUMMARY OF THE INVENTION

In a disclosed embodiment of this invention, a solenoid valve is placed in the discharge tube or into the discharge line adjacent to the compressor outwardly of the compressor housing. Preferably, the valve is closed shortly after a shutdown of the compressor motor. If the valve shuts closed before or immediately at shutdown of the motor, there is a potential problem with an increase in the pressure of refrigerant, since the motor will continue to run in a forward direction for a short period of time after the shutdown. However, if the valve shuts closed after a significant amount of time has expired after the motor shutdown, then the refrigerant from the condenser and discharge line will be able to re-expand back through the scroll elements causing them to run in reverse. Thus it is imperative to close the valve within a short time window for optimum performance. Thus, in a disclosed embodiment, preferably, the valve is closed between 0.1 second and 1.0 second after the shutdown of the motor. A solenoid valve is disclosed, but other valve types come within the scope of this invention.

In another feature, a high pressure switch is positioned upstream of the solenoid valve. If the solenoid valve should inadvertently close while the compressor is running, the high pressure switch will quickly sense an undesirable increase in pressure. The high pressure switch is preferably wired to a control, which can stop the motor, should an over-pressure situation be detected.

These and other features of the present invention can be best understood from the following specification and drawings, the following of which is a brief description.

DETAILED DESCRIPTION OF THE PREFERRED EMBODIMENT

Figure 1:
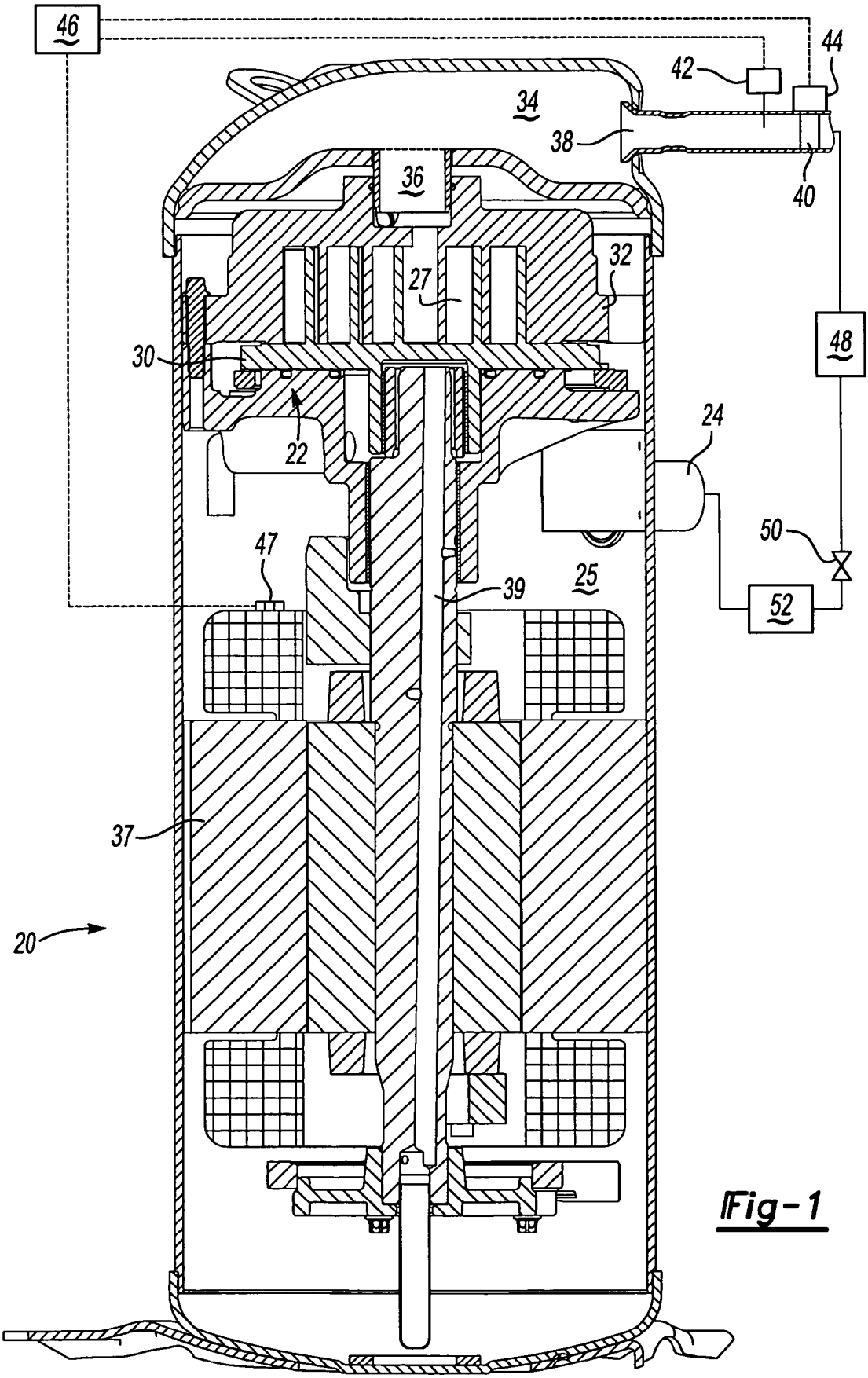
FIG. 1 is a schematic view of a refrigerant cycle incorporating the present invention.

A compressor 20 is illustrated in FIG. 1 having a compressor pump unit 22. A suction tube 24 delivers a suction refrigerant into a suction plenum 25. From the suction plenum 25, the refrigerant can pass upwardly into compression chambers 27 formed between an orbiting scroll member 30 and a non-orbiting scroll member 32. It is known that for a compressor pump unit 22, which utilizes scroll members, there is a problem with unpowered reverse rotation at a shutdown, as described above. While a scroll compressor is illustrated, any type of compressor that has a potential problem with unpowered reverse rotation (a screw compressor, for example) may benefit from this invention.

A discharge chamber 34 is shown directly downstream of a fixed scroll 32. As shown in the drawing, there is no check valve separating the discharge chamber 34 and the refrigerant exit from the fixed scroll port 36. The function of the check valve in this case is substituted by a valve member 40. As shown, from the chamber 34, refrigerant can pass through a discharge tube 38, and downstream towards a condenser 48, a main expansion device 50, and an evaporator 52.

While the invention is shown illustrated in a compressor 20 with the condenser 48 directly downstream, it should be understood that the inventive compressor can also be utilized in a refrigerant cycle incorporating the ability to select routing of the refrigerant from the discharge tube 38 either to the condenser 48, or to the evaporator 52. Such selective routing can be accomplished, for example, by using a four-way reversing valve 122 (see FIG. 2). Such refrigerant cycles are utilized in heat pump systems, and are known to a worker of ordinary skill in this art. Also the refrigerant system can additionally be equipped with vapor injection, liquid injection or by-pass unloading capabilities (see FIG. 3) as known in the art.

A motor 37 drives a shaft 39 to cause the orbiting scroll member 30 to orbit relative to the non-orbiting scroll member 32. Although the non-orbiting scroll member 30 is shown as a fixed scroll, this invention also extends to scroll compressors wherein the non-orbiting scroll can move axially.

The invention disclosed in this application relates to a valve member 40 that is operable by a solenoid valve control 44 to block a reverse flow of refrigerant from the condenser 48 through the tube 38 upon the compressor shutdown. Once again, other types of shut-off valves can be used as well.

As shown, a control 46 communicates with the valve control 44, and also with a shut-off switch 47 (positioned either inside or outside the compressor) for the motor 37. Further, an optional high pressure switch 42 senses the pressure in the tube 38 and communicates with the control 46.

When the control 46 causes the motor 37 to stop, it actuates the solenoid valve control 44 to drive the valve 40 to the closed position such as illustrated in FIG. 1. Prior to this actuation, the valve 40 is in a retracted position at which it does not block flow through the discharge tube 38. For safety consideration it is preferred to use a type of a valve that will maintain a normally open position after the power to this valve is cut off.

Preferably, this actuation occurs in a short period of time after the signal has been sent to stop the motor 37. This allows the motor to stop forward rotation, and prevent further compression, before the valve 40 precludes a flow of the compressed refrigerant. On the other hand, it is desirable that the valve 40 be moved to block the flow some time quite soon after the shutdown to prevent a reverse flow of refrigerant back through the tube 38 from the downstream locations, and potentially cause an unpowered reverse run situation. In a disclosed embodiment, this period of time is between 0.1 and 1.0 seconds. Of course, other time periods would be within the scope of this invention.

Further, since it is possible that the valve control 44 could malfunction and drive the valve 40 to its closed position, when the compressor is operating, high pressure switch 42 is utilized. Should high pressure switch 42 sense that the pressure in the tube 38 is higher than is expected or desirable, it may send a signal to the control 46. Control 46 is then operable to stop the motor 37 such that the malfunction can be evaluated. It is also within the scope of this invention to utilize a solenoid valve that will be forced to open if the pressure difference across the valve would exceed a certain predetermined value—in this case the use of a high pressure switch 42 may not be needed at all.

Figure 2:
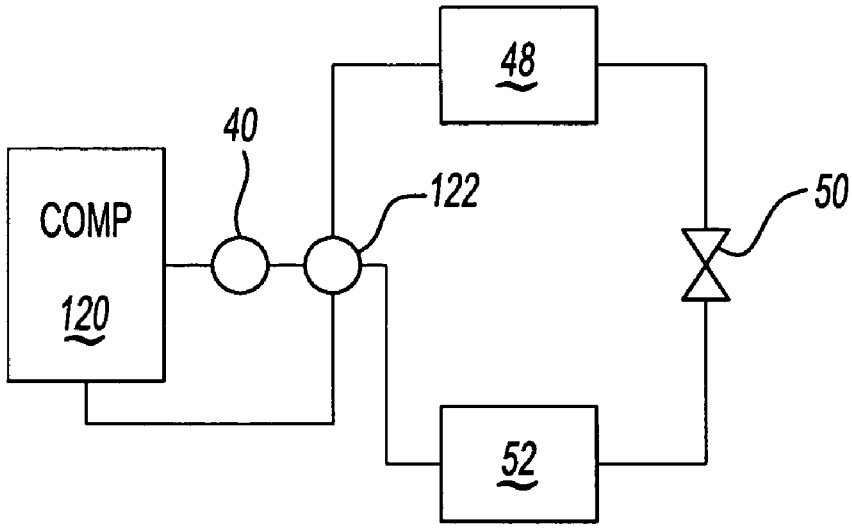
FIG. 2 shows optional features.

FIG. 2 shows a compressor 120, that again may be a screw or a scroll compressor or any other compressor prone to an unpowered reverse rotation. The further details shown by FIGS. 2 and 3 can be utilized in either a screw compressor or the previously illustrated scroll compressor. As shown, a valve 40 that functions as the prior disclosed valve is mounted on a discharge line for the compressor 120. The compressor 120, as shown in FIG. 2, is a part of a heat pump system having a four-way valve 122 that can selectively route refrigerant either to an outdoor heat exchanger 48, or to an indoor heat exchanger 52. Thus, the invention can be utilized in either a cooling mode or in a heating mode.

Figure 3:
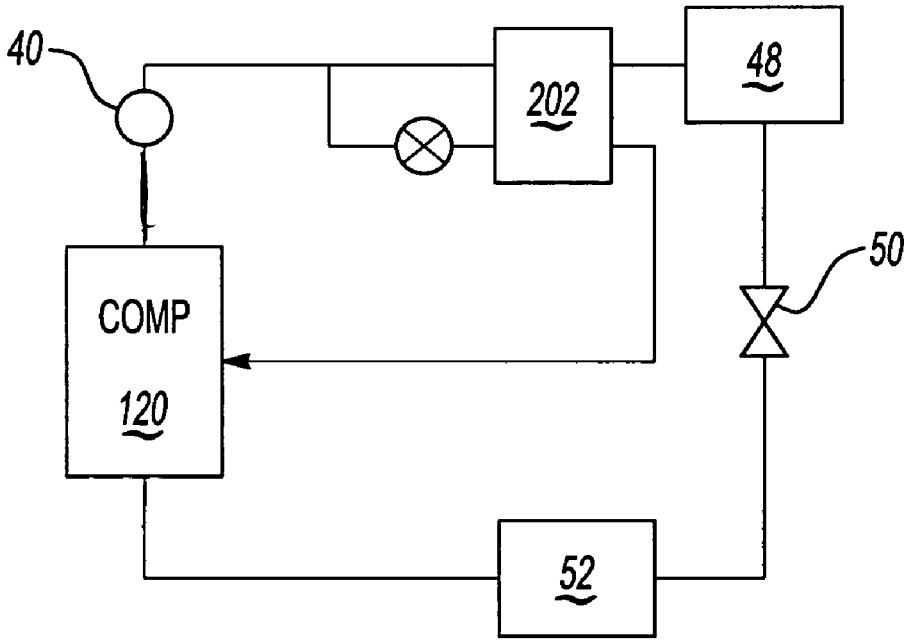
FIG. 3 shows further optional features.

FIG. 3 shows further possible features. In FIG. 3, the compressor 120 can again be either a scroll compressor or a screw compressor. An economizer heat exchanger 202 provides an economizer function and injection of a portion of the previously compressed refrigerant back to an intermediate compressor chamber(s) of the compressor 120. The features shown in FIGS. 2 and 3 are generally known. It is the incorporation of the valve 40, and the optional high pressure switch 42 that is inventive.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a compressor housing and a compressor pump unit;

a motor for driving said compressor pump unit;

said compressor pump unit being of the sort that is susceptible to unpowered reverse rotation, said compressor pump unit having compression chambers for compressing a refrigerant, and delivering the compressed refrigerant into a discharge chamber;

a powered shut-off valve for blocking flow of refrigerant at a location between said discharge chamber and a downstream heat exchanger, such that refrigerant cannot flow from the downstream heat exchanger into said discharge chamber when said power shut-off valve is in a closed position.

2. The compressor as set forth in claim 1, wherein said compressor pump unit is a scroll compressor pump unit.

3. The compressor as set forth in claim 1, wherein said compressor pump unit is a screw compressor pump unit.

4. The compressor as set forth in claim 1, wherein said powered shut-off valve is located on a compressor discharge tube.

5. The compressor as set forth in claim 1, wherein said powered shut-off valve is located on a compressor discharge line.

6. The compressor as set forth in claim 1, wherein a control for controlling said powered shut-off valve actuates said powered shut-off valve in a preset period of time, after said motor is stopped.

7. The compressor as set forth in claim 6, wherein said powered shut-off valve is actuated by said control in more than 0.1 second after power to said motor is cut off.

8. The compressor as set forth in claim 6, wherein said control actuates said powered shut-off valve between 0.1 and 1.0 second after power to said motor is cut off.

9. The compressor as set forth in claim 1, wherein a pressure switch is positioned upstream of said powered shut-off valve, said pressure switch communicating with a control for said electric motor, said pressure switch being operable to identify an undesirably high pressure upstream of said powered shut-off valve, and stop operation of said motor should an undesirably high pressure be sensed.

10. The compressor as set forth in claim 1, wherein said powered shut-off valve is a solenoid powered valve.

11. The compressor as set forth in claim 1, wherein said powered shut-off valve will open from its closed position if pressure exceeds a safe pressure.

12. The compressor as set forth in claim 1, wherein said powered shut-off valve is a normally open valve.

13. The compressor as set forth in claim 1, wherein a pressure differential switch is positioned to sense a pressure differential across said powered shut-off valve, said pressure differential switch communicating with a control for said powered shut-off valve, said pressure differential switch being operable to identify an undesirably high pressure differential across said powered shut-off valve, and stop operation of said motor should an undesirably high pressure differential be sensed.

14. The compressor as set forth in claim 1, wherein said powered shut-off valve will open from its closed position if a pressure differential exceeds a safe pressure differential.

15. The compressor as set forth in claim 1, wherein said powered shut-off valve is a valve equipped with a flow bypass that is opened when a pressure differential across the valve exceeds a safe pressure differential.

16. The compressor as set forth in claim 1, wherein said compressor pump unit delivering a compressed refrigerant through a discharge port and into the discharge chamber, refrigerant flowing from the discharge chamber passing through a discharge tube leaving the compressor housing, and said power shut-off valve being positioned in the discharge tube.

17. A refrigerant cycle comprising:

a compressor, said compressor being of the sort that is susceptible to unpowered reverse rotation, said compressor having compression chambers for compressing a refrigerant, and delivering the compressed refrigerant into a discharge chamber;

a heat exchanger positioned downstream of said compressor, refrigerant from said discharge chamber passing to said downstream heat exchanger; and a powered shut-off valve for blocking flow of refrigerant at a location between said discharge chamber and the downstream heat exchanger, such that refrigerant cannot flow from the downstream heat exchanger into said discharge chamber when said power shut-off valve is in a closed position.

18. The refrigerant cycle as set forth in claim 17, wherein said compressor pump unit is a scroll compressor pump unit.

19. The refrigerant cycle as set forth in claim 17, wherein said compressor pump unit is a screw compressor pump unit.

20. The refrigerant cycle as set forth in claim 17, wherein said powered shut-off valve is located on a compressor discharge tube.

21. The refrigerant cycle as set forth in claim 17, wherein said powered shut-off valve is located on a compressor discharge line.

22. The refrigerant cycle as set forth in claim 17, wherein a control for controlling said powered shut-off valve actuates said powered shut-off valve in a preset period of time, after said motor is stopped.

23. The refrigerant cycle as set forth in claim 22, wherein said powered shut-off valve is actuated by said control more than 0.1 second after power to said motor is cut off.

24. The refrigerant cycle as set forth in claim 22, wherein said control actuates said powered shut-off valve between 0.1 and 1.0 second after power to said motor is cut off.

25. The refrigerant cycle as set forth in claim 17, wherein a pressure switch is positioned upstream of said powered shut-off valve, said pressure switch communicating with a control for said electric motor, said pressure switch being operable to identify an undesirably high pressure upstream of said powered shut-off valve, and stop operation of said motor should an undesirably high pressure be sensed.

26. The refrigerant cycle as set forth in claim 17, wherein said powered shut-off valve is a solenoid powered valve.

27. The refrigerant cycle as set forth in claim 17, wherein said powered shut-off valve will open from its closed position if pressure exceeds a safe pressure.

28. The refrigerant cycle as set forth in claim 17, wherein said powered shut-off valve is a normally open valve.

29. The refrigerant cycle as set forth in claim 17, wherein a pressure differential switch is positioned to sense a pressure differential across said powered shut-off valve, said pressure differential switch communicating with a control for said powered shut-off valve, said pressure differential switch being operable to identify an undesirably high pressure differential across said powered shut-off valve, and stop operation of said motor should an undesirably high pressure differential be sensed.

30. The refrigerant cycle as set forth in claim 17, wherein said powered shut-off valve will open from its closed position if a pressure differential exceeds a safe pressure differential.

31. The refrigerant cycle as set forth in claim 17, wherein said powered shut-off valve is a valve equipped with a flow bypass that is opened when a pressure differential across the valve exceeds a safe pressure differential.

32. The refrigerant cycle as set forth in claim 17, where the refrigerant cycle is an air conditioning cycle.

33. The refrigerant cycle as set forth in claim 17, where the refrigerant cycle is a heat pump cycle.

34. The refrigerant cycle as set forth in claim 17, where the refrigerant cycle includes an economizer branch.

35. The refrigerant cycle as set forth in claim 17, wherein said compressor pump unit delivering a compressed refrigerant through a discharge port and into the discharge chamber, refrigerant flowing from the discharge chamber passing through a discharge tube leaving the compressor housing, and said power shut-off valve being positioned in the discharge tube.

36. A method of controlling a compressor comprising the steps of:

(1) compressing a refrigerant within a compressor pump unit, of the sort that is susceptible to unpowered reverse rotation;

(2) cutting power to a motor for driving said compressor pump unit; and (3) blocking flow of a compressed refrigerant from being expanded through compressor pump unit by actuating a powered valve, said flow of compressed refrigerant being blocked at a location downstream of a discharge chamber which receives the compressed refrigerant from the compressor pump unit.

* * * * *